US008974272B2

(12) United States Patent
Mornan et al.

(10) Patent No.: US 8,974,272 B2
(45) Date of Patent: Mar. 10, 2015

(54) ASPIRATING INDUCTION NOZZLE

(75) Inventors: Brian J. Mornan, Basking Ridge, NJ (US); Frank J. Beitz, Flemington, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 964 days.

(21) Appl. No.: 13/067,269

(22) Filed: May 20, 2011

(65) Prior Publication Data

US 2012/0292407 A1 Nov. 22, 2012

(51) Int. Cl.
*F23L 17/02* (2006.01)
*F24F 7/02* (2006.01)

(52) U.S. Cl.
CPC ..... *F24F 7/025* (2013.01)
USPC ..... 454/39; 454/23; 454/25; 454/42; 454/44; 239/419.5

(58) Field of Classification Search
CPC ... F24F 7/025; F24F 2013/0612; E04F 17/02; E04F 17/04; E04F 12/28; B05B 1/34; B05B 1/36
USPC ..... 454/25, 42, 3–4, 16–17, 36, 39–40, 47; 239/419.5
See application file for complete search history.

(56) References Cited

U.S. PATENT DOCUMENTS

| | | | | | |
|---|---|---|---|---|---|
| 409,990 | A * | 8/1889 | Loveless | 454/40 |
| 1,006,930 | A * | 10/1911 | Garland | 454/39 |
| 1,033,060 | A * | 7/1912 | Bos | 454/40 |
| 1,312,996 | A * | 8/1919 | Lister | 454/40 |
| 1,394,735 | A * | 10/1921 | Jordan | 454/40 |
| 2,188,564 | A * | 1/1940 | Berg | 454/39 |
| 2,483,922 | A * | 10/1949 | Messer | 454/39 |
| 2,626,557 | A * | 1/1953 | Hersch | 454/33 |
| 3,525,474 | A * | 8/1970 | Mills et al. | 239/265.17 |
| 3,528,614 | A * | 9/1970 | Honmann | 454/263 |
| 3,719,032 | A | 3/1973 | Cash | |
| 4,344,370 | A * | 8/1982 | Smith et al. | 454/39 |
| 4,422,524 | A * | 12/1983 | Osborn | 239/265.13 |
| 4,806,076 | A | 2/1989 | Andrews | |
| 5,439,349 | A | 8/1995 | Kupferberg | |
| 6,112,850 | A | 9/2000 | Secrest et al. | |
| 6,431,974 | B1 | 8/2002 | Tetley et al. | |
| 6,509,081 | B1 | 1/2003 | Diamond | |
| 6,676,503 | B2 | 1/2004 | Hill et al. | |
| 7,241,214 | B2 | 7/2007 | Sixsmith | |
| 7,484,929 | B1 * | 2/2009 | Fitzpatrick | 454/11 |
| 7,547,249 | B2 | 6/2009 | Seliger et al. | |
| 7,682,231 | B2 * | 3/2010 | Enzenroth et al. | 454/39 |
| 2005/0170767 | A1 * | 8/2005 | Enzenroth et al. | 454/36 |
| 2008/0200108 | A1 * | 8/2008 | Kupferberg | 454/40 |
| 2013/0193235 | A1 * | 8/2013 | Mornan et al. | 239/499 |

* cited by examiner

*Primary Examiner* — Alissa Tompkins
*Assistant Examiner* — Phillip E Decker
(74) *Attorney, Agent, or Firm* — Thomas J. Germinario

(57) ABSTRACT

An aspirating induction nozzle for vertical connection to the outlet of a pressurized exhaust gas flow comprises a central nozzle surrounded by a wind band and one or more guide vanes. Ambient air is induced into a mixing zone within the central nozzle to dilute the primary effluent and increase the volumetric discharge flow rate to achieve greater plume lift. The mixing zone within the central nozzle is protected from crosswind influences, which would otherwise diminish plume lift.

10 Claims, 6 Drawing Sheets

29
30
30
13
20
18
34
15
30
30
28
28
27

Fig. 7 (Present Invention)
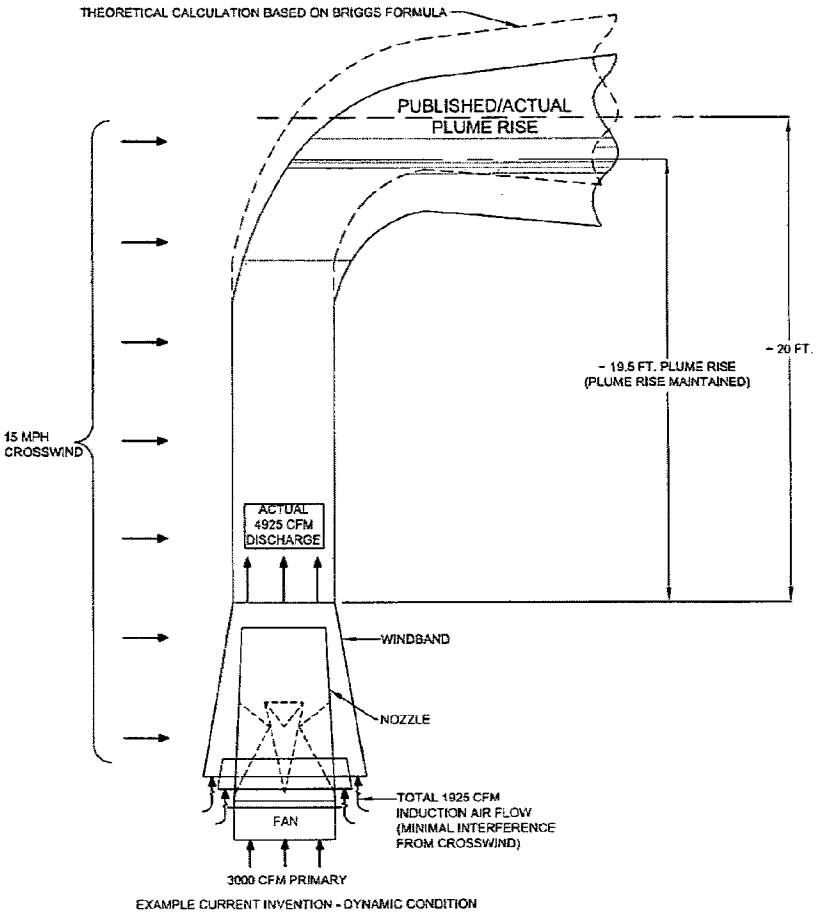
Fig. 6 (Prior Art)
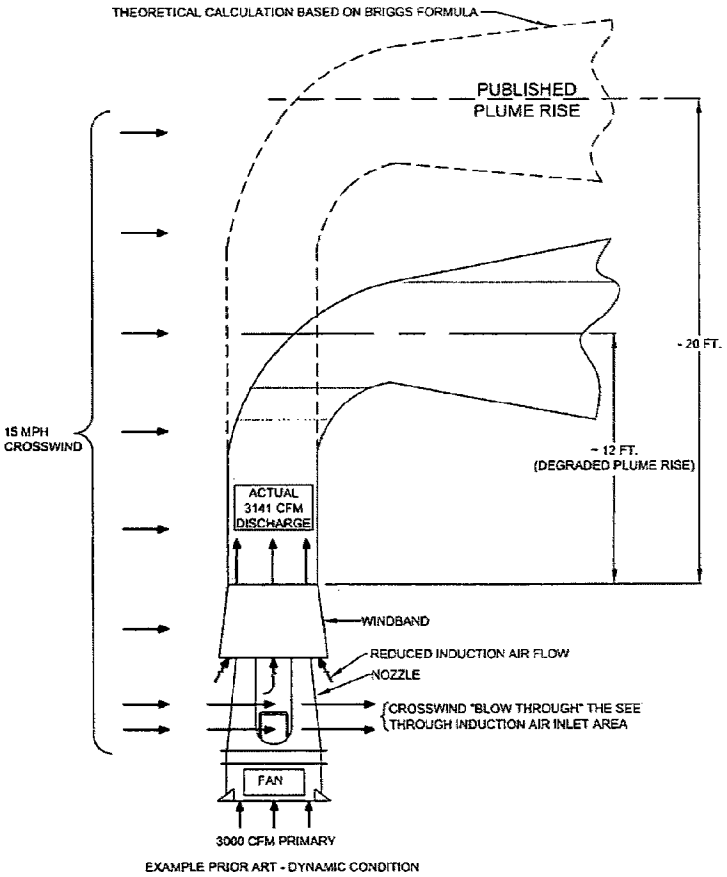

ASPIRATING INDUCTION NOZZLE

BACKGROUND OF THE INVENTION

The present invention relates to the field of exhaust air systems for buildings and/or other enclosed areas, and more particularly, to exhaust discharge nozzles configured to be attached to the outlets of exhaust fans, exhaust ducts and/or stacks, and similar exhaust type equipment/devices and are specifically designed to be installed in the outdoor ambient. The device is designed with a constriction at the outlet to accelerate the exhaust effluent at a high velocity into the atmosphere.

The application of discharge nozzles at the exit point of exhaust systems enhances the performance capability with the specific intent of maximizing the exhaust/effluent dispersion into the upper atmosphere of the unwanted contaminated air and/or effluent gases and vapors from buildings, rooms, and other enclosed spaces. They are able to provide a superior alternative to conventional tall exhaust stacks which are costly to construct and are visually unattractive by today's standards. Properly designed nozzles are capable of propelling high velocity plumes of exhaust gases to heights sufficient to prevent stack downwash and disperse the effluent over a large upper atmospheric area so as to avoid exhaust contaminant re-entrainment into building ventilation intake zones.

A further development of the constrictive exhaust nozzle design is the type nozzle that employs the Venturi effect to draw additional ambient air into the primary effluent stream. The venturi type nozzle can further be described as an aspirating, or induction type, as related to conventional technological description for this type nozzle. The additional induced air volume dilutes the primary exhaust gases at/near the nozzle as the combined mixed air volumes are released into the atmosphere. Also, with this exhaust-air mixture volume increase, the discharged gas is expelled at a higher, velocity, achieving a greater plume height. The underlying effect of greater volume at greater discharge velocity is increased effluent momentum, which assists with the effluent disbursement into the atmosphere.

The limitations of the prior art in this field relate primarily to two issues: (1) the performance of the nozzle in a crosswind, (2) adaptability of the nozzle as a retrofit to an existing exhaust system. With regard to the first issue, crosswinds not only affect the external plume height, in accordance with the Briggs equations (see below), but they can also interfere with and limit ambient air entrainment into the nozzle, thereby impairing the performance at the nozzle discharge. Concerning the second issue, prior art induction nozzles are designed to work with specific exhaust inlet diameters and pressures so that a new exhaust fan assembly must usually be purchased along with the nozzle. The aspirating induction nozzle of the present invention, on the other hand, has the dual advantages of maintaining near-optimal performance in crosswinds and being adaptable as a retrofit for many existing exhaust systems.

The current industry test standard, AMCA 260-07, is a static test based on a zero crosswind velocity, which does not reflect the true application of these devices. Therefore, the industry has not yet recognized the effect of crosswind "blow through" that can take place. The present invention addresses that problem. FIG. 6 illustrates the significantly degraded performance of one of the prior art induction nozzles in a crosswind (15 mph), as compared with FIG. 7 showing the substantially unimpaired performance of the present invention in the equivalent crosswind.

The present invention is designed to be installed on an effluent discharge fan or stack, so as to induce ambient air through induction ports to mix with the primary effluent within a nozzle controlled chamber that is protected from ambient influences, such as crosswinds. The outlets of the induction ports interface with the primary effluent outlets in a radial mixing zone grid within the nozzle interior. In the design of a specific nozzle for a given application, the number, size, and configuration of the induction ports can be arranged, based on the diameter and pressure requirements at the nozzle inlet, to achieve the required discharge velocity of the diluted effluent in accordance with ANSI standard Z9.5 2003. The nozzle of this design extends beyond the interior mixing zone through a length sufficient to allow the process of discharge air static regain to achieve a more uniform velocity profile across the nozzle outlet area, thereby optimizing mixing of the nozzle primary discharge with the induced airflow through the outer wind band annulus surrounding the nozzle.

The intra-nozzle radial mixing zone of the present invention has distinct advantages over the prior art of aspirating type nozzles, in which the induced ambient air mixing takes place peripherally at the nozzle outlet, well beyond the protected environment of the nozzle itself. The two principal advantages of intra-nozzle radial mixing, as opposed to extra-nozzle peripheral mixing, are, (1) more uniform mixing of the ambient air and primary effluent across the entire nozzle outlet and, (2) isolation of the mixing zone from disruption by ambient crosswinds.

A second distinguishing feature of the present invention vis-à-vis the prior art is that the multiple induction ports are not interconnected with each other. In the present invention, the induction air port inlets at the nozzle exterior surface are separated from each other, as are the port outlets terminating within the nozzle interior area. The structure of the nozzle assembly forms individual passageways for the induced ambient air to enter only into the intra-nozzle mixing zone. Several prior art designs use a bifurcated frusto-conical nozzle with a "see-through" central passive zone that functions as the inlet for induced air flow. This "see-through" design allows crosswinds to freely "blow through" the nozzle's passive zone instead of entering the aspiration air column and mixing with the primary exhaust discharge (as depicted in FIG. 6). Such crosswind pass-through impairs the performance of the nozzle by diminishing effluent dilution and reducing the nozzle discharge volume, thereby also reducing plume height.

A third distinguishing feature of the present invention is the extension of the nozzle beyond the mixing zone to create a "developing zone," in which static regain occurs downstream of the radial mixing zone, within the protection of the nozzle from external crosswind influences. The static regain process converts velocity pressure to static pressure, so as to increase the static pressure of the mixed air column at the nozzle discharge, thereby increasing its motive force for greater plume lift. The static regain that occurs in the developing zone also produces a more uniform cross-nozzle flow velocity profile, which helps integrate the converging air columns from the nozzle and the wind band.

A fourth distinguishing feature of the present invention is a frusto-conical full-length wind band, completely encompassing the nozzle, which extends from or below the induction port inlet level to beyond the nozzle discharge outlet. This has the advantages of (1) protecting the induction port inlets and mixing zone from crosswind disruption, and (2) preventing noise breakout from the nozzle. The full-length wind band also creates an induction annulus between the wind band and the nozzle, thereby setting up a laminar outer aspirated ambient air column surrounding the semi-turbulent inner diluted primary effluent air column. This latter feature increases plume height by both increasing the volume rate of discharge and reducing turbulent energy losses across the outer air column boundary. Several other prior art designs offer only nominal windband protection at the nozzle discharge opening, and the consequent exposure to crosswind influence at the nozzle discharge can cause deterioration of plume height performance with "blow through" across the discharge area.

A fifth distinguishing feature of the present invention comprises one or more short frusto-conical guide vane(s) band in axial annular spaced relation between the lower end of the wind band and the nozzle. The guide vane(s) direct(s) ambient air vertically into the induction ports and block(s) horizontal wind components that would disrupt the mixing zone. The guide vane(s) also work(s) in tandem with the wind band to limit noise breakout at the nozzle entry area. The guide vane(s) thereby contribute to the protection of the entire ambient air entry area surrounding the nozzle against crosswind disruption.

A sixth distinguishing feature of the present invention comprises full-length mounting brackets positioned at the nozzle exterior, between the nozzle and the wind band, wherein the brackets form individual vertical air passageways for each of the ambient air induction ports and maintain the wind band and guide vane(s) in annular spaced relation to minimize crosswind effects, which could otherwise circumvent and disrupt the intended vertical air flow direction.

The mounting arrangement of the induction ports within the nozzle of the present invention also allows for readily attaching, within the nozzle interior, integral sound attenuating material, without reconfiguring the nozzle exterior profile or significantly increasing nozzle static pressure losses at the primary air passageway. The intent of adding this material is to assist with attenuating sound generated by any air flow moving equipment located at the primary air entry end of the nozzle. The nozzle design also readily accepts additional traditional attenuation devices, if needed, that could be located at the nozzle entry point.

The forgoing features and their associated functions have not been achieved by the prior art in this field. With the present invention, each of these above described components function individually, and cooperatively, to assist in the induction of ambient air into the primary air stream for the purpose of maximizing effluent plume height and dilution with minimum interference from ambient crosswind, as shown in FIG. 7. On the other hand, performance modeling of several prior art designs indicates that plume height and dilution performance can be diminished by as much as 40% in a 15 mile-per-hour crosswind, as illustrated in FIG. 6.

The U.S. patent of Cash (U.S. Pat. No. 3,719,032) describes multiple nested venturi nozzles mounted on top of an effluent stack. Since induced ambient air mixes peripherally with primary effluent above each venturi stage, the Cash device lacks the intra-nozzle radial mixing zone which is the first key feature of the present invention. It also lacks the advantages of the full-length wind band of the present invention.

The U.S. patent of Andrews (U.S. Pat. No. 4,806,076) teaches a bifurcated frusto-conical nozzle with dual arcuate venturi nozzles circumferentially disposed around a central "see-through" passive zone, which is the source of induced ambient air. As in the Cash patent, the mixing of exhaust flows with induced ambient air takes place peripherally above the nozzle outlets. The wind band is not full-length over the nozzles and does not shield the passive zone ambient air inlets from crosswind disruption. Moreover, the interconnected "see-through" induced air inlets are subject to crosswind pass-through, which impairs nozzle performance, as explained above. Guide vanes are also absent in the Andrews design, and the short wind band mounting brackets do not channel air into the induction zone inlets. The U.S. patents to Kupferberg (U.S. Pat. No. 5,439,349) and Secrest et al. (U.S. Pat. No. 6,112,850) are variations of the Andrews bifurcated "see-through" design, with Secrest adding acoustic-silencing wraps around the nozzle exterior.

The U.S. patent of Tetley et al. (U.S. Pat. No. 6,431,974) teaches the Andrews "see-through" design with multiple nested wind band sections in vertically spaced relation over the arcuate nozzle outlets. This configuration sets up a succession of extra-nozzle peripheral mixing zones, as opposed to the single mixing zone of Andrews, Kupferberg and Secrest et al. Andrews' deficiencies with respect to full-length wind band, guide vanes and mounting bracket also apply to Tetley et al.

In the U.S. patent of Hill et al. (U.S. Pat. No. 6,676,503), a multi-lobed aspirating nozzle has exterior induction ports formed by the concave exterior portions of the lobed nozzle. Because the induction ports never penetrate the nozzle wall, as in the present invention, however, the mixing of induced ambient with the exhaust flow still occurs outside of and peripheral to the nozzle lobes. The deficiencies of the Andrews design with respect to the wind band/guide vane/bracket configuration also apply to Hill et al.

The U.S. patent of Sixsmith (U.S. Pat. No. 7,241,214) teaches the multi-lobed aspirating nozzle of Hill et al., with the addition of vertical and horizontal wind-deflecting members. While these members somewhat perform the functions of the guide vanes and bracket of the present invention, in terms of creating vertical channels for the ambient air to enter the induction ports, the ports remain exposed to crosswinds because the wind band does not extend down to the port inlets. And, as with prior art discussed above, mixing of ambient air with effluent continues to take place externally and peripherally to the nozzle outlets.

In the U.S. patent to Selinger et al. (U.S. Pat. No. 7,547,249), there is an explicit recognition (column 2, lines 5-20) of the inefficiency of extra-nozzle peripheral mixing of induced ambient air with primary effluent. Instead of relocating the mixing zone within the nozzle, however, Selinger reconfigures the nozzle outlet in an H shape to increase the size of the peripheral mixing area. While the induction ports are better defined in this configuration, they remain external to the nozzle and their inlets remain exposed to ambient crosswinds.

Therefore, all the prior art aspirating induction nozzles share, in varying degrees, the problem of degraded performance in ambient crosswinds and inefficient mixing of the induced air with the primary exhaust gas. In addition, they all lack the scalability of the present invention, and hence are not adaptable to retrofitting existing fan/stack installations.

SUMMARY OF THE INVENTION

The present invention is an aspirating induction nozzle assembly for vertical connection to the outlet of a pressurized exhaust gas flow, typically the outlet of an exhaust fan. The nozzle assembly comprises a tubular or frusto-conical central nozzle, a long frusto-conical wind band, which is attached in annular spaced relation to the exterior of the central nozzle by multiple mounting brackets, and one or more short frusto-conical guide vane(s), which are attached in annular spaced relation—or stepped annular spaced relation for multiple guide vanes—by the mounting brackets between the central nozzle and the wind band.

The central nozzle comprises a nozzle inlet opening at the lower end, a nozzle discharge opening at the upper end, multiple ambient air induction ports, a primary effluent passage, a mixing zone and a developing zone. Each of the induction ports has an induction inlet and an induction outlet. The induction inlets extend obliquely upward and inward from the exterior mid-section of the central nozzle, through the wall of the central nozzle to the mixing zone, where they terminate in the induction outlets. The induction outlets extend radially toward the center of the primary effluent passage so as to form a grid pattern defined by alternating radial segments or bands, consisting of induction outlets alternating with radial arms of the constricted primary effluent passage. This grid pattern provides an extended boundary for intermixing of the primary effluent stream with the induced ambient stream. The central nozzle extends upward beyond the mixing zone through the developing zone to the nozzle discharge opening.

The frusto-conical wind band comprises a wind band inlet opening at the lower end, and a wind band discharge opening at the upper end. The wind band convergingly extends annularly from surrounding the mid-section of the central nozzle to surrounding the nozzle discharge opening. The wind band discharge opening is preferably larger than the nozzle discharge opening and is located above it.

Multiple mounting brackets extend from the wind band inlet opening to the nozzle discharge opening. They attach the wind band to the central nozzle and maintain the wind band in a converging annular spaced relation to the central nozzle. The guide vanes are also supported by the mounting brackets in the annular areas between the wind band and the central nozzle. The guide vanes convergingly extend annularly, or annularly stepped, above the wind band inlet opening and around the induction inlets of the central nozzle.

The induction of ambient air into the primary effluent is initiated by the primary effluent flowing at a high velocity over and around the induction port outlets, which radially extend into the primary effluent passage to form the grid pattern defining the intra-nozzle mixing zone, as described above. As a result of the high velocity flow through the constricted primary effluent passage, the Venturi effect produces negative pressure voids at the induction port outlets. These negative pressure voids at the induction port outlets draw ambient air into the mixing zone through the induction ports from the induction port inlets. The radially-alternating configuration of the mixing zone provides for thorough mixing of the induced ambient air with the primary effluent to produce a combined diluted mixture flow of increased volume. This diluted mixture flow then passes through an extended developing zone within the central nozzle above the mixing zone. In the developing zone, the high velocity pressure leaving the mixing zone is converted to static pressure by the process of static regain. This increase in static pressure provides more force at the nozzle discharge opening to achieve better plume lift. Static regain in the developing zone also achieves a more uniform velocity profile across the nozzle, which enables better mixing of the nozzle discharge with the induced ambient air flow through the wind band.

The flow exiting the nozzle discharge opening comprises the primary effluent flow mixed and pressure-equalized with the induced ambient air flow from the induction ports. A secondary induction process takes place at the nozzle discharge opening, whereby the velocity of the nozzle discharge flow draws an annular column of ambient air through the wind band. Consequently, the total flow exiting the wind band discharge opening comprises the nozzle discharge flow annularly surrounded by secondary induced ambient air flow through the wind band. The laminar flow of the outer secondary induced air column increases plume height by reducing turbulent energy losses at the outer boundary of the combined flow column.

Mixing of the primary effluent with ambient air not only dilutes the effluent, but also increases the height of the plume by increasing the volume of the combined flow. The plume height of the discharged gas/air column increases proportionately with the discharged flow volume and velocity in accordance with the Briggs formula:

$$h=(3v/u)\times d$$

where:

h=plume height above discharge point (ft)

v=discharge flow velocity (ft/min FPM)

u=horizontal crosswind velocity (FPM)

d=diameter of discharge opening (ft)

Since the discharged volumetric flow rate V is the product of the flow velocity v and the diameter of the discharge opening d, the Briggs formula can be alternately expressed in a form which explicitly indicates the direct proportionality of plume height to discharged gas/air volume:

$$h=3V/u$$

where:

V=volumetric discharge flow rate (cu ft/min CFM)

The present invention, unlike the prior art induction nozzles, is scalable to accommodate various primary effluent exhaust flow rates. The nozzle discharge opening is sized to handle the combined mixture of primary effluent and induced ambient air volumes, and incremental nozzle sizes are designed to manage a minimum 3000 feet per minute (FPM) discharge flow velocity in accordance with ANSI Z-9.5 2003 requirements.

An example of the scalability of the present invention is illustrated in FIG. 1. Based on a volumetric discharge flow rate of 13,375 cubic feet per minute (CFM) in a 15 mile-per-hour crosswind, we can apply the Briggs formula to estimate a plume height of approximately 30.4 ft. With a minimum 10-foot elevation of the discharge outlet above the roof line, in accordance with ANSI Z-9.5 2003, this gives an effective stack height of about 40.4 ft. At a design discharge flow velocity of 3250 FPM, again in accordance with ANSI Z-9.5 2003, this requires that the nozzle discharge opening have an area of $$13{,}375\ \text{CFM}/3{,}250\ \text{FPM}=4.12\ \text{sq ft}$$

which equates to a nozzle discharge opening diameter of approximately 2.3 ft.

In the illustrative example given in FIG. 1, the primary effluent exhaust flow rate is 9000 CFM, which requires a dilution ratio of about 1.5:1 in order to produce the design total discharge rate of 13,375 CFM. To retrofit an existing exhaust system with a flow rate of 7000 CFM, on the other hand, the dilution ratio to achieve 13,375 total plume discharge would be roughly 2:1. An induction nozzle for such a retrofit application, as compared to the illustrative example, would be designed for a higher dilution ratio by increasing the number and/or size of the induction ports so as to increase the flow of ambient air into the nozzle's mixing zone.

The full-length wind band of the present invention shields the induction inlets against atmospheric crosswind currents. The wind band and the central nozzle are positioned and fastened together by the vertical interconnecting mounting brackets. These mounting brackets extend the full height of the annular space between the exterior of the central nozzle and the interior of the wind band to form an individual ambient air channels for each induction inlet. By directing ambient air into the induction inlets through these defined channels, the mounting brackets prevent crosswind currents from circulating around the annular space between the central nozzle and the wind band. Preferably, the top of the wind band is open to the nozzle discharge outlet to induce a peripheral secondary ambient air flow annularly around the nozzle discharge flow.

One or more annular guide vanes are positioned near the bottom of the wind band to assist with directing ambient air toward the induction inlets. The guide vane(s) also help reduce turbulence of the secondary induced ambient air flow through the wind band.

The combined structure of the full-length wind band, mounting brackets and guide vane(s) cooperate to attenuate noise. Further noise attenuation can be achieved by acoustic treatment of these components and/or the central nozzle.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIG. 6 is a schematic depiction of the modeled performance of a "see-through" prior art induction nozzle in a 15 mph crosswind; and FIG. 7 is a schematic depiction of the modeled performance of an aspirating induction nozzle in accordance with the present invention in a 15 mph crosswind.

DETAILED DESCRIPTION OF THE PREFERRED EMBODIMENTS

Figure 1:
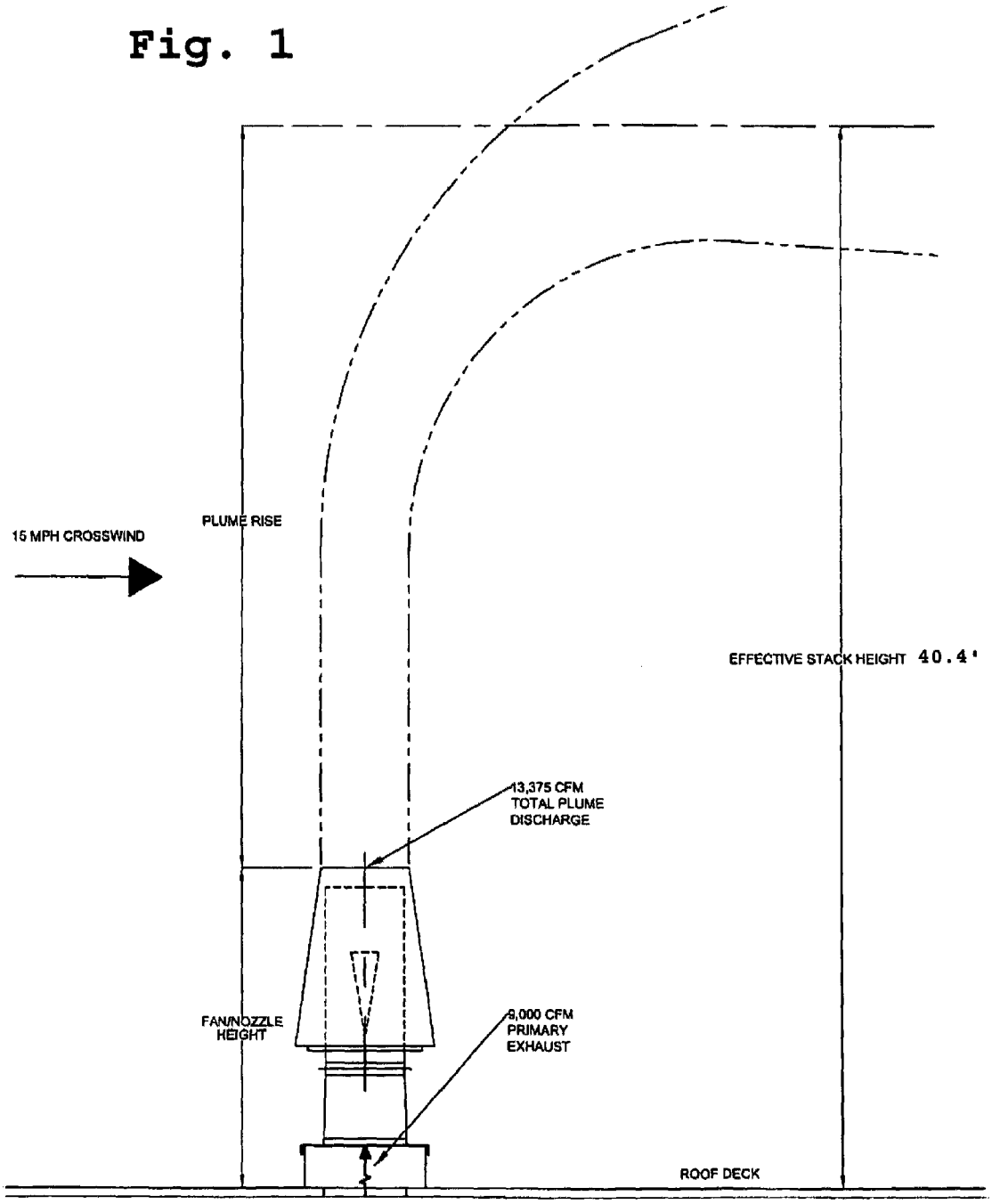
FIG. 1 is a schematic depiction of some of the operational parameters of the present invention.

Referring to FIGS. 2A through 2D, an aspirating induction nozzle assembly 10 is designed for vertical connection to an exhaust gas outlet 11 by means of a connecting flange 32. The nozzle assembly 10 comprises a tubular or frusto-conical central nozzle 12, a long frusto-conical wind band 13, which is attached in annular spaced relation to the central nozzle 12 by multiple mounting brackets 14, and a short frusto-conical guide vane 15, which is attached in annular spaced relation by the mounting brackets 14 between the central nozzle 12 and the wind band 13. Multiple guide vane clips 33 are used to attach the guide vane 15 to the mounting brackets 14.

The central nozzle 12 comprises a nozzle inlet opening 16 at the lower end, a nozzle discharge opening 17 at the upper end, multiple ambient air induction ports 18, a primary effluent passage 19, a mixing zone 20 and a developing zone 21. Each of the induction ports 18 has an induction inlet 22 and an induction outlet 23. The induction inlets 22 extend obliquely upward and inward from the exterior mid-section of the central nozzle 12, through the wall of the central nozzle 12 to the mixing zone 20, where they terminate in the induction outlets 23. The induction outlets 23 extend radially toward the center of the primary effluent passage 19 so as to form a grid pattern 24 defined by alternating radial segments or bands, consisting of induction outlets 23 alternating with radial arms of the constricted primary effluent passage 19. This grid pattern 24 provides an extended boundary for intermixing of the primary effluent stream with the induced ambient stream. The central nozzle 12 extends upward beyond the mixing zone 20 through the developing zone 21 to the nozzle discharge opening 17.

Figure 2A:
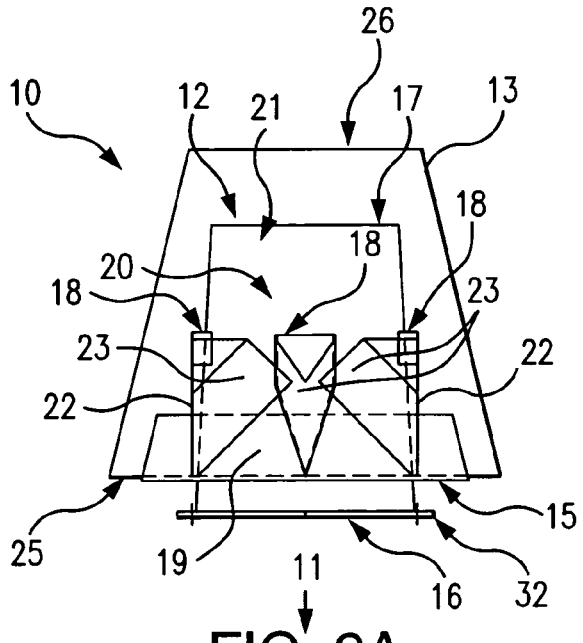
FIG. 2A is a cross-section view of an exemplary embodiment of an aspirating induction nozzle assembly in accordance with the present invention.
Figure 2B:
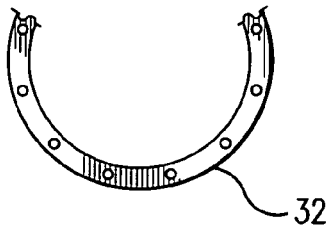
FIG. 2B is a plan detail view of the connecting flange component of FIG. 2A.
Figure 2C:
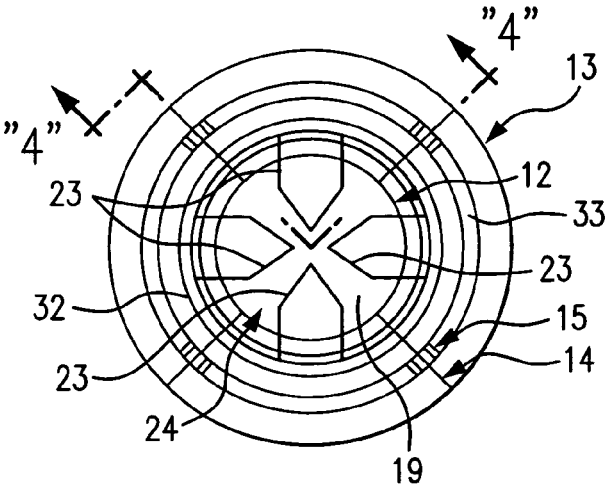
FIG. 2C is a plan view of the exemplary embodiment shown in FIG. 2A.
Figure 2D:
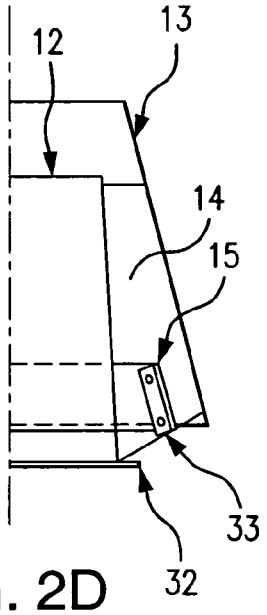
FIG. 2D is a section of the plan view along the line "4-4" in FIG. 2C.
Figure 3:
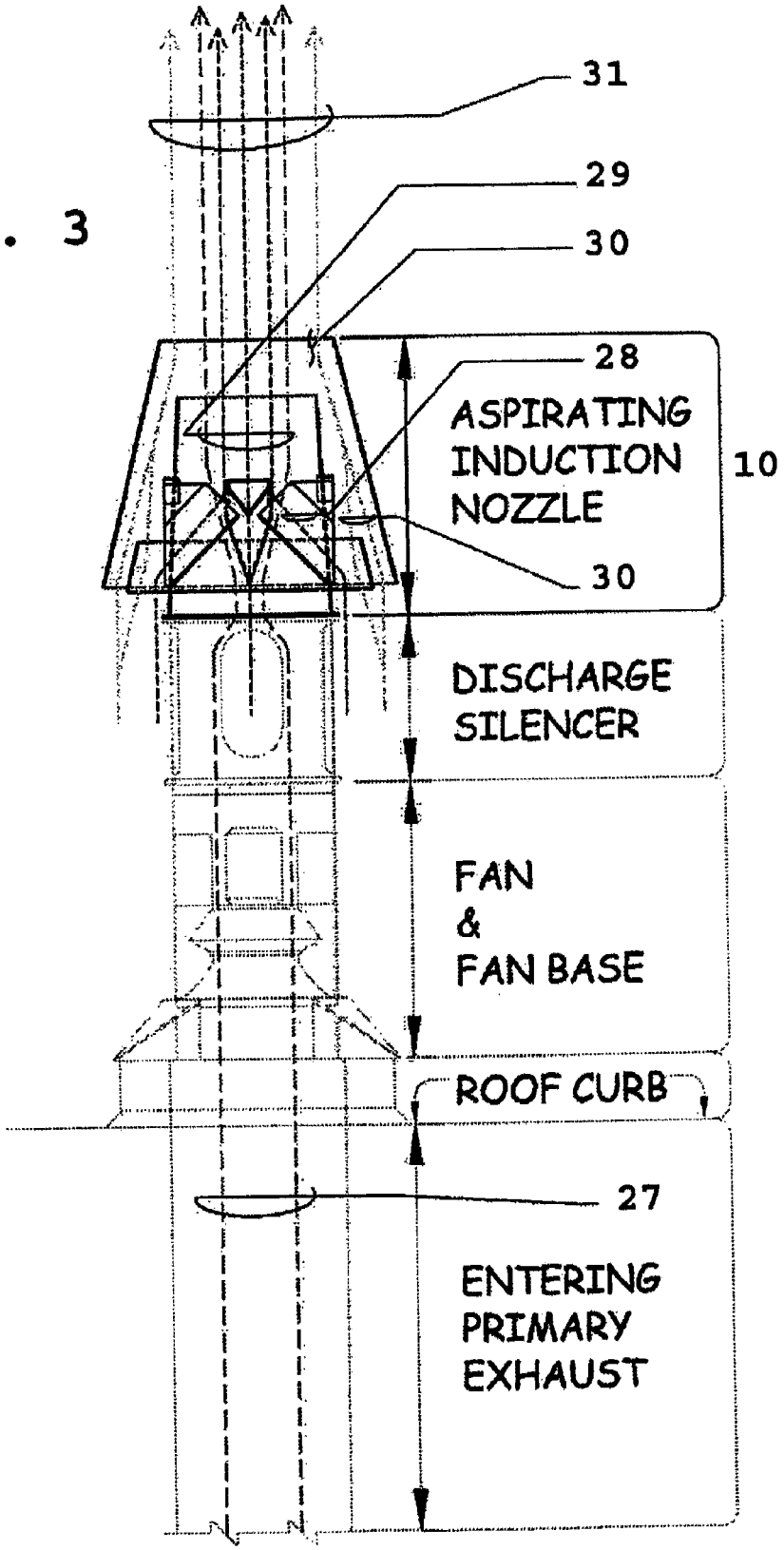
FIG. 3 is a cross-section view of the exemplary embodiment of FIG. 2A, showing the constituents of the air/gas flow through the aspirating induction nozzle assembly, and showing the upstream exhaust gas connections in ghost view.
Figure 4:
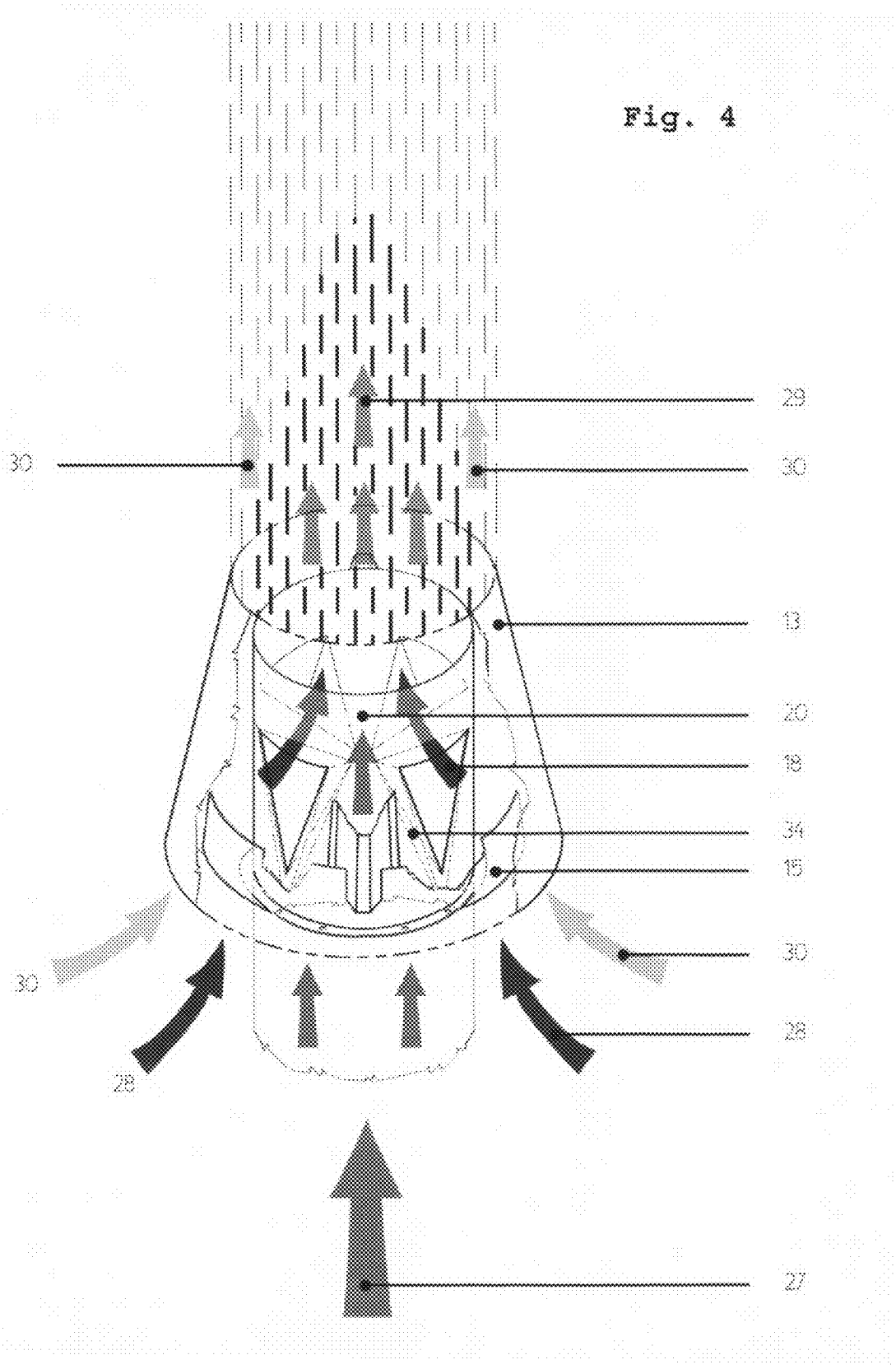
FIG. 4 is a cut-away perspective view of the exemplary embodiment of FIG. 2A, showing the constituents of the air/gas flow through the aspirating induction nozzle assembly.
Figure 5A:
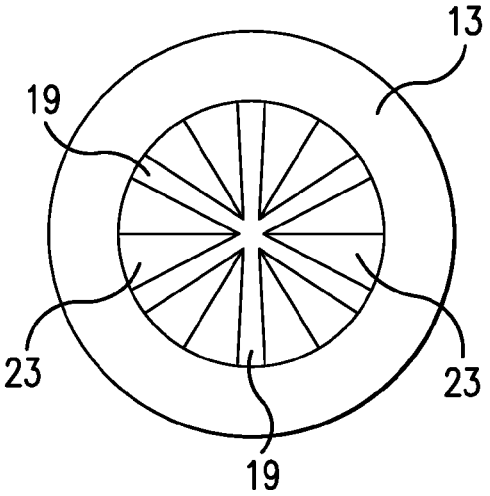
FIG. 5A is a plan view of an exemplary alternate embodiment of an aspirating induction nozzle assembly in accordance with the present invention.
Figure 5B:
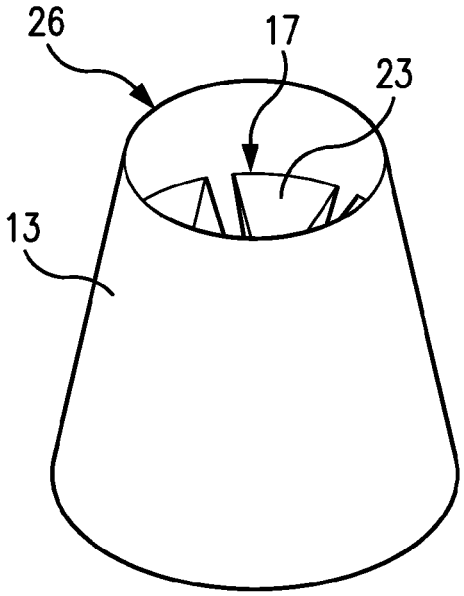
FIG. 5B is a top perspective view of the alternate embodiment of FIG. 5A.
Figure 5C:
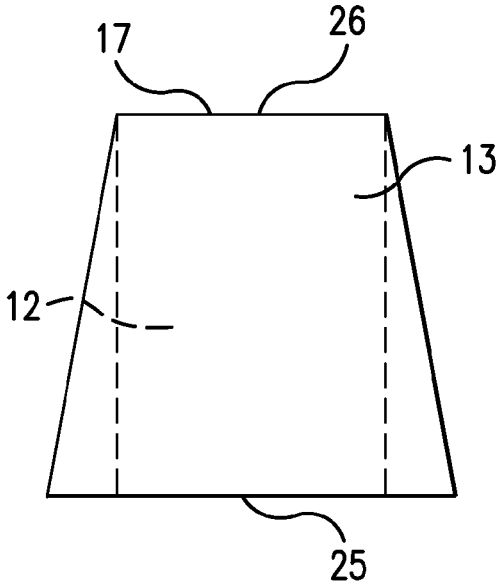
FIG. 5C is a side profile view of the alternate embodiment of FIG. 5A.
Figure 5D:
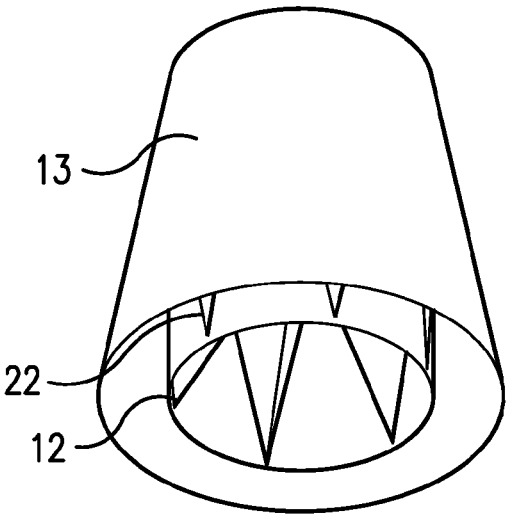
FIG. 5D is a bottom perspective view of the alternate embodiment of FIG. 5A.

It should be understood that the grid pattern 24 configuration of the alternating radial induction outlets 23 and radial arms of the primary effluent passage 19, as shown in FIG. 2C, is but one of many possible grid pattern configurations. In the alternate embodiment depicted in FIGS. 5A and 5B, there are more induction ports and induction outlets 23—six as compared to four in FIG. 2C—resulting in greater constriction of the primary effluent passage 19. This alternate embodiment will increase the volume of ambient air relative to the primary effluent and thus increase the dilution ratio of the discharged air/gas mixture.

The frusto-conical wind band 13 comprises a wind band inlet opening 25 at the lower end, and a wind band discharge opening 26 at the upper end. In the exemplary embodiment illustrated in FIGS. 2A-2D, the wind band 13 convergingly extends annularly from below the mid-section of the central nozzle 12 to above the nozzle discharge opening 17. In this embodiment, the wind band discharge opening 26 is larger than the nozzle discharge opening and is located above it. In the alternate embodiment depicted in FIGS. 5A-5D, the wind band discharge opening 26 is coterminous with the nozzle discharge opening 17, and the wind band 13 extends below the bottom of the central nozzle 12. This alternate design will force more ambient air into the induction inlets 22, because the annular air path between the wind band 13 and the central nozzle 12 has no outlet.

Referring again to FIGS. 2A-2D, multiple mounting brackets 14 extend from the wind band inlet opening 25 to the nozzle discharge opening 17. The mounting brackets 14 attach the wind band 13 to the central nozzle 12 and maintain the wind band 14 in a converging annular spaced relation to the central nozzle 12. The guide vane 15 is also supported by the mounting brackets 14 in the annular area between the wind band 13 and the central nozzle 12. The guide vane 15 convergingly extends annularly above the wind band inlet opening 25 and around the induction inlets 22 of the central nozzle 12.

Referring now to FIGS. 2A, 2C, 3 and 4, the induction of ambient air into the primary effluent is initiated by the primary effluent 27 flowing at a high velocity over and around the induction outlets 23, which radially extend into the primary effluent passage 19 to form the grid pattern 24 defining the intra-nozzle mixing zone 20. As a result of the high velocity flow through the constricted primary effluent passage 19, the Venturi effect produces negative pressure voids at the induction outlets 23. These negative pressure voids at the induction port outlets draw ambient air 28 into the mixing zone 24 through the induction ports 18 from the induction 22 inlets. The radially-alternating configuration of the mixing zone 24 provides for thorough mixing of the induced ambient air 28 with the primary effluent 27 to produce a combined diluted mixture flow 29 of increased volume. This diluted mixture flow 29 then passes through an extended developing zone 21 within the central nozzle 12 above the mixing zone 24. In the developing zone 21, the high velocity pressure leaving the mixing zone 24 is converted to static pressure by the process of static regain.

The flow exiting the nozzle discharge opening 17 comprises the primary effluent flow 27 mixed and pressure-equalized with the induced ambient air flow 28 from the induction ports 18. A secondary induction process takes place at the nozzle discharge opening 17, whereby the velocity of the nozzle discharge flow 29 draws an annular column of ambient air 30 through the wind band 13. Consequently, the total flow exiting the wind band discharge opening 31 comprises the nozzle discharge flow 29 annularly surrounded by secondary induced ambient air flow 30 through the wind band 13.

In the alternate embodiment depicted in FIGS. 5A-5D, the wind band 13 converges to become coterminous with the central nozzle 12 at the nozzle discharge opening 17, such that the wind band discharge opening 26 and the nozzle discharge opening 17 merge into one combined opening. This alternate design induces ambient air within the wind band 13 to flow into the induction inlets 22 of the central nozzle 12, due to the lower pressure relationship (negative pressure at the induction outlets 23).

The full-length wind band 13 of the present invention 10 shields the induction inlets 22 against atmospheric crosswind currents. The wind band 13 and the central nozzle 12 are positioned and fastened together by the vertical interconnecting mounting brackets 14. These mounting brackets 14 extend the full height of the annular space between the exterior of the central nozzle 12 and the interior of the wind band 13 to form an individual ambient air channels for each induction inlet 22. By directing ambient air into the induction inlets 22 through these defined channels, the mounting brackets 14 prevent crosswind currents from circulating around the annular space between the central nozzle 12 and the wind band 13.

The annular guide vane 15 positioned near the bottom of the wind band 13 also assists with directing ambient air toward the induction inlets 22. The guide vane also helps reduce turbulence of the secondary induced ambient air flow through the wind band. The combined structure of the full-length wind band 13, mounting brackets 14 and guide vane 15 cooperate to attenuate noise. Further noise attenuation can be achieved by acoustic treatment 34 of these components and/or the central nozzle.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

As used in the following claims, "proximal" and "distal" are in relation to the exhaust gas outlet connection to the nozzle. "Upward" or "above" is in the "distal" direction, i.e., away from the exhaust gas outlet connection, while "downward" or "below" is in the "proximal" direction, i.e., toward the exhaust gas outlet connection. "Inward" is toward the central longitudinal axis of the nozzle. The "radial" direction is in relation to one of the circular transverse cross-sections of the nozzle.

What is claimed is:

1. An aspirating induction nozzle assembly for vertical connection to a pressurized exhaust gas outlet, comprising:

a tubular or frusto-conical central nozzle defined by a nozzle wall, and a frusto-conical wind band, which is attached in converging annular spaced relation to the exterior of the central nozzle by multiple mounting brackets;

wherein the central nozzle comprises a proximal nozzle inlet opening, a distal nozzle discharge opening, multiple ambient air induction ports, a primary effluent passage, through which primary effluent from the exhaust gas outlet flows through the interior of the central nozzle, and a mixing zone within the interior of the central nozzle;

wherein each of the induction ports has an induction inlet and an induction outlet, and wherein the induction inlets extend obliquely upward and inward from the exterior of the central nozzle and penetrate through the nozzle wall into the mixing zone, where they terminate in the induction outlets;

wherein the induction outlets extend radially toward the axial center of the primary effluent passage, so as to constrict the primary effluent passage into multiple radial arms which radially alternate with the induction outlets to define a grid pattern in the mixing zone;

wherein the constriction of the primary effluent passage in the mixing zone causes the exhaust gas to flow at a velocity at or above 3000 feet per minute over and around the induction outlets, creating negative pressure voids at the induction outlets and thereby inducing ambient air through the induction inlets into the mixing zone, where the grid pattern provides an extended boundary for intermixing of the primary effluent with the induced ambient air to produce a diluted combined nozzle discharge flow that has a greater volume than the primary effluent and that is discharged at the nozzle discharge opening; and wherein the wind band comprises a proximal wind band inlet opening and a distal wind band discharge opening and convergingly extends annularly around the central nozzle from at or below the induction inlets to at or above the nozzle discharge opening, such that a secondary induction process takes place at the nozzle discharge opening, whereby the nozzle discharge flow induces an annular secondary column of ambient air through the wind band, so as to produce a wind band discharge flow comprising the nozzle discharge flow surrounded by the annular secondary column of ambient air induced through the wind band.

2. The aspirating induction nozzle assembly of claim 1, wherein the central nozzle further comprises a developing zone located within the central nozzle above the mixing zone and below the nozzle discharge opening, and wherein a process of static regain takes place within the developing zone, whereby the static pressure of the combined nozzle discharge flow increases to provide more force at the nozzle discharge opening to achieve greater plume lift, and whereby a more uniform velocity profile of the combined nozzle discharge flow across the central nozzle is achieved to enable better mixing of the combined nozzle discharge flow with the annular secondary column of ambient air induced through the wind band.

3. The aspirating induction nozzle assembly of claim 2, wherein the mounting brackets extend the full length of the annular space between the exterior of the central nozzle and the interior of the wind band to define individual ambient air channels leading to each of the induction inlets, and wherein the ambient air channels direct ambient air into the induction inlets and block crosswind currents from circulating around the annular space between the central nozzle and the wind band.

4. The aspirating induction nozzle assembly of claim 3, further comprising one or more frusto-conical guide vanes, which are attached by the mounting brackets in annular spaced relation, or stepped annular spaced relation for multiple guide vanes, between the central nozzle and the wind band, wherein the guide vanes cooperate with the mounting brackets in directing ambient air toward the induction inlets and in blocking crosswind currents, and wherein the guide vanes reduce turbulence of the annular secondary column of ambient air induced through the wind band.

5. The aspirating induction nozzle assembly of claim 4, wherein the wind band, mounting brackets and guide vanes cooperate to attenuate noise from the exhaust gas outlet, and wherein one or more of the components of the nozzle assembly are acoustically treated to attenuate noise from the exhaust gas outlet.

6. An aspirating induction nozzle assembly for vertical connection to a pressurized exhaust gas outlet, comprising:

a tubular or frusto-conical central nozzle defined by a nozzle wall, and a frusto-conical wind band, which is attached in converging annular spaced relation to the exterior of the central nozzle by multiple mounting brackets;

wherein the central nozzle comprises a proximal nozzle inlet opening, a distal nozzle discharge opening, multiple ambient air induction ports, a primary effluent passage, through which primary effluent from the exhaust gas outlet flows through the interior of the central nozzle, and a mixing zone within the interior of the central nozzle;

wherein each of the induction ports has an induction inlet and an induction outlet, and wherein the induction inlets extend obliquely upward and inward from the exterior of the central nozzle and penetrate through the nozzle wall into the mixing zone, where they terminate in the induction outlets;

wherein the induction outlets extend radially toward the axial center of the primary effluent passage, so as to constrict the primary effluent passage into multiple radial arms which radially alternate with the induction outlets to define a grid pattern in the mixing zone;

wherein the constriction of the primary effluent passage in the mixing zone causes the exhaust gas to flow at a velocity at or above 3000 feet per minute over and around the induction outlets, creating negative pressure voids at the induction outlets and thereby inducing ambient air through the induction inlets into the mixing zone, where the grid pattern provides an extended boundary for intermixing of the primary effluent with the induced ambient air to produce a diluted combined nozzle discharge flow that has a greater volume than the primary effluent and that is discharged at the nozzle discharge opening; and wherein the wind band comprises a proximal wind band inlet opening and a distal wind band discharge opening and convergingly extends annularly around the central nozzle from at or below the induction inlets to the nozzle discharge opening, where the wind band discharge opening becomes coterminous with the nozzle discharge opening, such that ambient air within the wind band is forced to flow into the induction inlets of the central nozzle, thereby augmenting the combined nozzle discharge flow through the nozzle discharge opening.

7. The aspirating induction nozzle assembly of claim 6, wherein the central nozzle further comprises a developing zone located within the central nozzle above the mixing zone and below the nozzle discharge opening, and wherein a process of static regain takes place within the developing zone, whereby the static pressure of the combined nozzle discharge flow increases to provide more force at the nozzle discharge opening to achieve greater plume lift, and whereby a more uniform velocity profile of the combined nozzle discharge flow across the central nozzle is achieved.

8. The aspirating induction nozzle assembly of claim 7, wherein the mounting brackets extend the full length of the annular space between the exterior of the central nozzle and the interior of the wind band to define individual ambient air channels leading to each of the induction inlets, and wherein the ambient air channels direct ambient air into the induction inlets and block crosswind currents from circulating around the annular space between the central nozzle and the wind band.

9. The aspirating induction nozzle assembly of claim 8, further comprising one or more frusto-conical guide vanes, which are attached by the mounting brackets in annular spaced relation, or stepped annular spaced relation for multiple guide vanes, between the central nozzle and the wind band, wherein the guide vanes cooperate with the mounting brackets in directing ambient air toward the induction inlets and in blocking crosswind currents.

10. The aspirating induction nozzle assembly of claim 9, wherein the wind band, mounting brackets and guide vanes cooperate to attenuate noise from the exhaust gas outlet, and wherein one or more of the components of the nozzle assembly are acoustically treated to attenuate noise from the exhaust gas outlet.

* * * * *